US005347734A

United States Patent [19]

Howell et al.

[11] Patent Number: 5,347,734

[45] Date of Patent: Sep. 20, 1994

[54] MODULAR DISPLAY DEVICE

[76] Inventors: Lloyd A. Howell, 3281 Renfro Ave., Cincinnati, Ohio 45211; Peter N. Kurlas, 5018 Cleves-Warsaw Pike, Cincinnati, Ohio 45238

[21] Appl. No.: 27,949

[22] Filed: Mar. 8, 1993

[51] Int. Cl.[5] ..... G09F 11/02

[52] U.S. Cl. ..... 40/506; 40/493; 40/658; 211/163

[58] Field of Search ..... 40/5, 479, 493, 642, 40/506, 658, 666; 211/58, 78, 131, 163; 248/161

[56] References Cited

U.S. PATENT DOCUMENTS 1,509,125 9/1924 Burbank ..... 40/493
1,527,024 2/1925 Brookbank ..... 40/493
3,711,975 1/1973 Downing ..... 40/506
4,505,059 3/1985 Morris ..... 40/493 X
4,738,038 4/1988 Tanne et al. ..... 40/493 X
5,046,274 9/1991 David ..... 40/493 X

*Primary Examiner*—Brian K. Green
*Attorney, Agent, or Firm*—Wood, Herron & Evans

[57] ABSTRACT

A rotatable display device is described which is intended to improve tabletop and store environments by reducing clutter, increasing product promotion awareness, and freeing-up valuable table space. The display device is also designed in a manner which limits the amount of wear and tear it receives due to handling and food and beverage spillage. The display device includes a frame with multiple display faces and a support member rotatably coupled to the frame.

20 Claims, 1 Drawing Sheet

MODULAR DISPLAY DEVICE

FIELD OF THE INVENTION

The present invention is directed to a display device, and more particularly to a rotatable display device for use on tabletops and counter tops.

BACKGROUND OF THE INVENTION

The display of promotional materials on tabletops and counter tops in restaurants and bars is typically accomplished through the use of display "tents" which sit directly on the tabletops, or two-sided cards held in the rings of ring-top condiment holders. There are various drawbacks associated with these types of display devices. Displays which sit directly on a tabletop or counter top are less visible and tend to become worn or deteriorate from spilled beverages, food and clean-up. Additionally, tabletop displays take up valuable table space and require frequent handling to enable patrons to fully view their contents. Furthermore, display cards held in ring-top condiment holders may not be readily viewable by all patrons at a table and therefore must be removed and handled, thus subjecting the cards to increased wear and tear, or the associated condiment holder pivoted to allow complete viewing.

There is a distinct need for tabletop and counter top display devices which are readily viewable by patrons, which free up table space, and which are not subject to wear and tear due to spilled food, beverages, clean-up, and handling.

SUMMARY OF THE INVENTION

The present invention is directed to a rotatable display device which is intended to improve tabletop and store environments by reducing clutter, increase product promotion awareness, and free-up valuable table space. Furthermore, the display device is designed so that it is not subject to nearly the amount of wear and tear as prior art devices.

In its broadest aspects, the display device of the present invention includes a frame which is adapted to receive one or more display cards. The frame has a predetermined geometric cross-section, such as triangular, square, rectangular, hexagonal, etc., and has a plurality of display faces for exhibiting promotional or other materials. The display device further includes a support member which is rotatably coupled to the frame and supports the frame in a desired display orientation. Since the frame and support member are rotatably coupled, the frame is easily pivoted or rotated by persons viewing the display to permit full viewing of all promotional or display materials.

In a preferred embodiment, the frame is comprised of a plurality of vertical and horizontal legs which define a predetermined number of display faces. The frame further includes a transverse web interconnecting the vertical legs. The web has a central aperture or opening therein and a downwardly extending annular skirt, both of which are sized to receive the support member therethrough, thus permitting rotatable coupling of the support member and the frame. Finally, the support member preferably includes a downwardly extending tab which is designed to engage the ring of a ring-top condiment holder to thereby support the entire display device above the condiment holder on a tabletop or counter top.

In an alternative embodiment, the display device of the present invention includes its own detachable base member for supporting the display device on a counter top or tabletop, and thus not requiring the presence of ring-top condiment holders. This enables the display device to be used in locations other than restaurants and bars to display promotional materials. In this embodiment, the base member preferably includes an upwardly extending annular skirt for receiving the tab of the support member. In a preferred aspect of this embodiment, the tab member and base member include cooperating elements which enable the base and the display device to be lockingly engaged to one another.

In addition to the foregoing, further features and advantages of the present invention will become apparent to persons skilled in the art upon review of the following detailed description taken in conjunction with the drawings.

DETAILED DESCRIPTION

With reference to the Figures, a preferred embodiment of a display device 10 of the present invention is shown. The depicted embodiment has a triangular cross-section; however, it will be appreciated that virtually any other geometric cross-section can be utilized, particularly square, hexagonal, or even cylindrical, to provide a suitable number of display faces.

Figure 1:
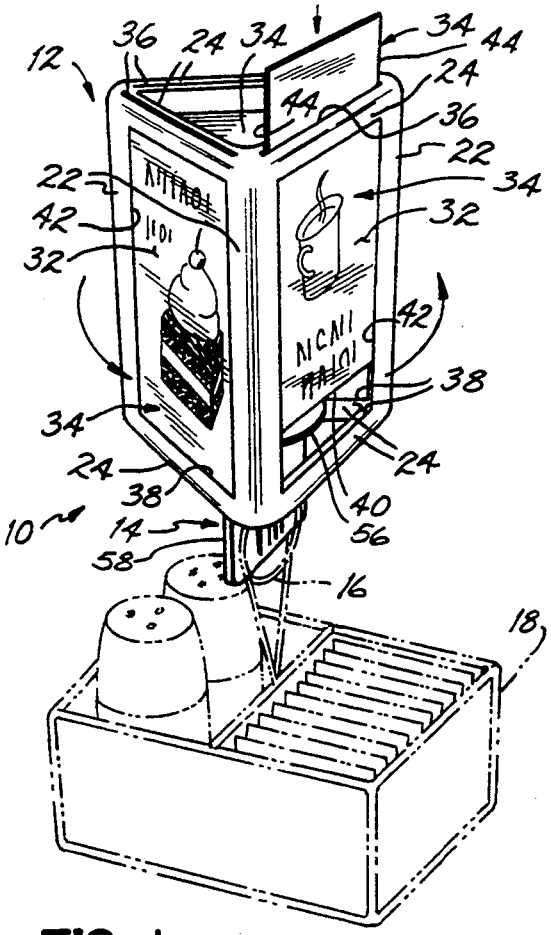
FIG. 1 is a perspective view showing a display device of the present invention in engagement with a ring-top condiment holder (shown in phantom)

Display device 10 comprises a frame 12 and a support member 14. As shown in FIG. 1, display device 10 is adapted to engage the ring 16 of a ring-top condiment holder 18 (shown in phantom). In an alternative embodiment shown in FIG. 4, display device 10 includes a base member 20 for supporting the display device on a planar surface such as a tabletop or counter top (not shown).

Figure 2:
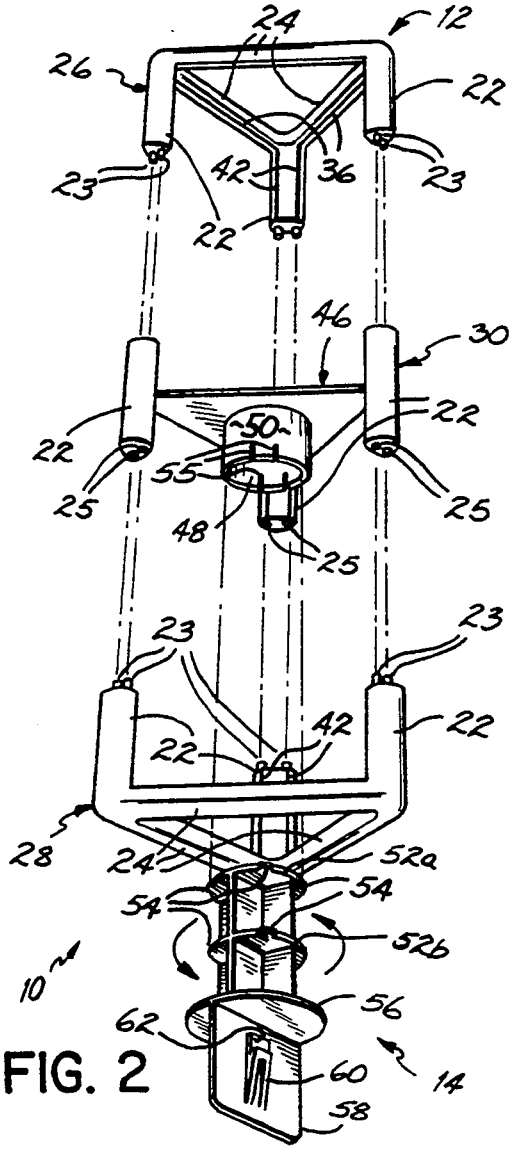
FIG. 2 is an exploded perspective view of one embodiment of a display device of the present invention.
Figure 3:
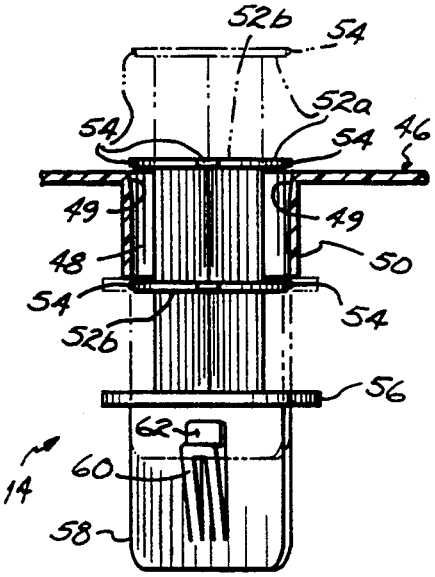
FIG. 3 is an enlarged, partial cross-sectional view showing two positions (one in phantom) of a support member engaging a frame member.

With specific reference to FIGS. 2 and 3, frame 12 of display device 10 preferably comprises a plurality of vertical legs 22 and horizontal legs 24. In the particular embodiment shown in FIG. 2, frame 12 is a modular unit comprising upper, lower and middle sections, 26, 28, 30, respectively. These sections are preferably held together by interlocking pins 23 in upper and lower sections 26, 28 which are received in holes 25 in middle section 30. It will be appreciated that vertical legs 22 may be unitary elements with horizontal legs 24 interconnecting vertical legs 22 at their upper and lower ends, rather than the three separate sections shown.

As best shown in FIG. 1, when assembled, display device 10 defines a plurality of display faces 32 and frame 12 is adapted to receive one or more display cards 34. It will be appreciated that the number of vertical legs 22 generally will be equal to the number of predetermined display faces 32. Display cards 34 are inserted in display device 10 through slots 36 in upper horizontal legs 24. These slots 36 pass completely through upper horizontal legs 24 so that cards 34 may be inserted therethrough and occupy display face 32, to thereby be fully visible, yet fully supported by frame 12. Additionally, lower horizontal legs 24 preferably each have a channel 38 therein to receive a lower edge 40 of card 34. Furthermore, vertical legs 22 each have channels 42 along their edges adjacent each display face 32 to receive the lateral edges 44 of display cards 34.

As shown in FIG. 2, frame 12 further includes a web 46 which interconnects vertical legs 22 and is substantially parallel to the horizontal legs 24. Web 46 further includes a central aperture 48 and an annular, downwardly extending skirt 50 which defines a tubular entry to aperture 48. Support member 14 is rotatably receivable through annular skirt 50 and central aperture 48.

As shown in FIGS. 2 and 3, support member 14 includes two disc-shaped engaging members 52*a* and *b*. Each engaging member 52 has a plurality of outwardly extending peripheral lugs 54 for frictionally engaging the interior of annular skirt 50 and which are slidably receivable therein. To facilitate entry of support member 14 in annular skirt 50, a plurality of slits 55 are provided in skirt 50 to allow some flexing thereof.

With specific reference to FIG. 3, display device 10 may be held in one of two different vertical positions, as represented by the two positions of support member 14 shown (one in phantom). By inserting support member 14 such that upper disc-shaped engaging member 52*a* passes through annular skirt 50 and central aperture 48, display device 10 is held in an extended position with the frame at its highest relative position as measured in the vertical direction. By further inserting support member 14 so that lower disc-shaped engaging member 52*b* has also passed through skirt 50 and central aperture 48, and thus is in the position shown in phantom in FIG. 3, frame 12 is in a relatively lower vertical position. This design feature allows vertical positioning of display device 10 to be adjusted depending upon the circumstances surrounding its use. It will be appreciated that more than two vertical positions can be achieved by providing support member 14 with multiple disc-shaped engaging members 52. Central aperture 48 includes ramp-shaped notches 49 which facilitate sliding of disc-shaped engaging members 52 and their peripheral lugs 54 through central aperture 48.

Support member 14 further includes a lower shield 56 which has a diameter greater than that of annular skirt 50 and thus limits the extent to which support member 14 can be inserted through annular skirt 50 and central aperture 48. Finally, support member 14 includes a downwardly-extending tab member 58 which has a pair of ramp-shaped lugs 60 designed to releasably engage ring 16 of ring-top condiment holder 18, and thus secure display device 10 in place thereon. Ramp-shaped lugs 60 may include one or more step-down shoulders 62 so that tab 58 is receivable by the different sized rings found in ring-top condiment holders.

Figure 4:
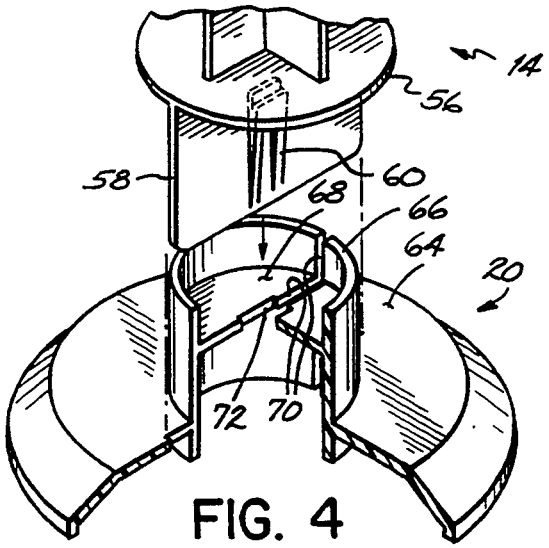
FIG. 4 is a perspective view, partially broken away, showing a support member just prior to engagement with a base member of a display device of the present invention.

In an alternative embodiment shown in FIG. 4, display device 10 includes a base member 20 for independently supporting display device 10 on a tabletop or counter top, thereby dispensing with the need for ring-top condiment holders. As shown, base 20 includes a plate 64 which stably supports the entire display device 10 on a planar surface (not shown). Plate 64 includes a central, upwardly extending annular skirt 66 which has a horizontal web 68. Skirt 66 and web 68 have a transverse slot 70 formed therein for receiving tab member 58. Preferably, slot 70 has a widened section 72 designed to receive ramp-shaped lugs 60 on tab member 58 of support member 14, thereby facilitating locking engagement between those elements.

Having thus described a preferred embodiment of the display device of the present invention, it will be appreciated by persons skilled in the art that various modifications can be made to the structures shown and described herein without departing from the spirit and scope of the present invention as defined by the appended claims.

What is claimed is:

1. A display device, comprising:

a frame adapted to receive one or more display cards, said frame having a predetermined geometric cross-section; and a support member rotatably coupled to said frame for positioning said frame in a desired display orientation, said support member including a downwardly extending tab having means for engaging a ring of a ring-top holder.

2. The display device of claim 1, said frame including a plurality of vertical and horizontal legs.

3. The display device of claim 2, said frame defining a predetermined number of display faces.

4. The display device of claim 3, said frame including a number of vertical legs equal to the number of predetermined display faces.

5. The display device of claim 2, said frame having a triangular cross-section and a predetermined height.

6. The display device of claim 5, said frame including three vertical legs defining said triangular cross-section of said device and six horizontal legs, three of said horizontal legs interconnecting said vertical legs at a lower end thereof and the other three of said horizontal legs interconnecting said vertical legs at an upper end thereof.

7. The display device of claim 6, said frame further including a web interconnecting said vertical legs, said web being substantially parallel to said horizontal legs.

8. The display device of claim 7, said web having a central aperture and an annular skirt extending downwardly from said web a distance approximately equal to the diameter of said skirt, said skirt defining a tubular entry to said aperture, said support member rotatably receivable through said annular skirt and central aperture.

9. The display device of claim 1, said tab having a first side and a second side, and said engaging means comprising at least one lug on one of said first and second sides.

10. The display device of claim 9, said engaging means comprising a ramp-shaped lug on each of said first and second sides of said tab.

11. The display device of claim 10, said lugs each having a step-down shoulder to facilitate engagement with various sized rings of ring-top holders.

12. A display device, comprising:

a frame including a plurality of vertical and horizontal legs defining a predetermined number of display faces, said frame having a predetermined geometric cross-section and adapted to receive one or more display cards; and a support member rotatably coupled to said frame for positioning said frame in a desired display orientation, said support member including a downwardly extending tab having means for engaging a ring of a ring-top holder.

13. The display device of claim 12, said tab having a first side and a second side, and said engaging means comprising at least one lug on one of said first and second sides.

14. The display device of claim 13, said engaging means comprising a ramp-shaped lug on each of said first and second sides of said tab.

15. The display device of claim 14, said frame further including a web interconnecting said vertical legs, said web having a central aperture and an annular skirt extending downwardly from said web a distance approximately equal to the diameter of said skirt, said skirt defining a tubular entry to said aperture, said support member rotatably receivable through said annular skirt and central aperture.

16. The display device of claim 15, said support member having at least one disc-shaped engaging member received through said annular skirt and central aperture, said tab member extending downwardly from said disc-shaped member.

17. The display device of claim 16, said device further comprising a base member for supporting said device on a planar surface, said base member engageable with said tab member.

18. The display device of claim 17, said base member comprising a support plate and an upwardly extending annular skirt for receiving said tab member.

19. The display device of claim 18, said base member including cooperating means for locking engagement with said lugs of said tab member.

20. The display device of claim 15, said support member having at least two disc-shaped engaging members received through said annular skirt, said engaging members spaced vertically and adapted to support said frame in a desired vertical position.

* * * * *